US010080410B2

(12) United States Patent
Holzkenner

(10) Patent No.: US 10,080,410 B2
(45) Date of Patent: Sep. 25, 2018

(54) CHARITY BOX DEVICE

(71) Applicant: Stewart Holzkenner, Fort Lauderdale, FL (US)

(72) Inventor: Stewart Holzkenner, Fort Lauderdale, FL (US)

( * ) Notice: Subject to any disclaimer, the term of this patent is extended or adjusted under 35 U.S.C. 154(b) by 0 days.

(21) Appl. No.: 15/821,489

(22) Filed: Nov. 22, 2017

(65) Prior Publication Data

US 2018/0177269 A1 Jun. 28, 2018

Related U.S. Application Data

(60) Provisional application No. 62/439,307, filed on Dec. 27, 2016.

(51) Int. Cl.

| | |
|---|---|
| ***A45C 1/12*** | (2006.01) |
| ***A45C 15/00*** | (2006.01) |
| ***G07D 11/00*** | (2006.01) |

(52) U.S. Cl.

CPC ..... *A45C 1/12* (2013.01); *A45C 15/00* (2013.01); *G07D 11/0036* (2013.01); *G07D 11/0078* (2013.01); *G07D 11/0096* (2013.01)

(58) Field of Classification Search

CPC ..... A45C 1/12; A45C 15/00; G07D 11/0036; G07D 11/0078; G07D 11/0096; G09B 19/18; A63H 33/00

USPC ..... 232/4 R, 1 D; 446/8; 206/0.815; 109/53; 434/107

See application file for complete search history.

(56) References Cited

U.S. PATENT DOCUMENTS

| | | | | | |
|---|---|---|---|---|---|
| 3,992,805 | A * | 11/1976 | Arkin | A45C 1/12 | 446/8 |
| 5,716,211 | A * | 2/1998 | Vetter | G09B 19/18 | 434/107 |
| 6,116,977 | A * | 9/2000 | Tanny | A45C 1/12 | 232/10 |
| 6,976,619 | B2 * | 12/2005 | Beacham | A45C 1/12 | 109/53 |
| 7,347,356 | B2 * | 3/2008 | Fields | A45C 1/02 | 206/0.81 |
| 8,789,745 | B1 * | 7/2014 | Barbary | A45C 1/12 | 232/4 R |
| 9,767,711 | B2 * | 9/2017 | Moumneh | G09B 19/18 | |
| 2008/0108272 | A1 * | 5/2008 | Lin | A45C 1/12 | 446/8 |
| 2009/0176432 | A1 * | 7/2009 | Hardin | A45C 1/12 | 446/8 |
| 2012/0232980 | A1 * | 9/2012 | Wald | G06Q 30/0233 | 705/14.27 |
| 2013/0273843 | A1 * | 10/2013 | Shimota | G06Q 20/3278 | 455/41.1 |
| 2015/0017611 | A1 * | 1/2015 | Moumneh | G09B 5/00 | 434/107 |

* cited by examiner

*Primary Examiner* — William L Miller

(74) *Attorney, Agent, or Firm* — Fleit Gibbons Gutman Bongini & Bianco P.L.; Paul D. Bianco; Gary S. Winer

(57) ABSTRACT

A new charity box device is provided which counts the acts of charity and the dollar amounts inserted by the users of the device by inserting coins into the coin counter. The device then relays the total counts of acts of charity and dollar amounts to a remote database, which may be on a website that is accessible for the user from any computer or internet device. The total amounts may also be obtained and displayed by the device.

12 Claims, 6 Drawing Sheets

CHARITY BOX DEVICE

BACKGROUND OF THE INVENTION

1. Field of the Invention

The present invention relates to a device that counts acts of charity and the amount of money donations for charity. Further, the present invention displays data, stores data, and relays data regarding the acts of charity and the money donated to a remote database that may be accessible via the internet.

2. Description of the Related Art

This invention relates to a device which tallies and calculates acts of charity and total amounts of funds to be given to charity. One focus of this invention is the tracking of the number of the acts in a predetermined period and a lifetime tally of charitable acts.

Many people practice giving kind acts of charity to others in need. There are many different congregations and religious practices that exist in today's society that encourages others to do so. One thing that all human beings have in common is the possibility of doing an act of charity to another human being. We teach this principle to our children, friends, family and community, but there are no devices that will specifically keep track of how many kind acts you do throughout the day, or throughout a preselected amount of time.

There is currently no device that can keep track of acts of personal charity. Further, there is no device that keeps track of all charity done all over the world linked to a particular act of charity, wherein the data may be accessed remotely. There is a need for a device that can teach and encourage users and others to do acts of charity in the world so that society can grow together to be caring, kind, and have generous morals.

People who give to others may not keep track of all their generosity. However, if a person were to be provided with an accurate count, perhaps then the person could set short term and long term goals. Currently people gather together with a common goal, such as to raise a needed amount of money to donate for a particular good cause. However, while the money is being collected, a leader of the cause would need an easily accessible way to determine how the fundraising is progressing. Furthermore, that leader has no idea how well the individuals raising charitable funds are doing. It may also be desirable to show publicly that acts of charity are performed every day which would inspire others to give.

Thus it can be seen that there remains a need for a device that counts acts of charity and donations of money for charity.

Further, there remains a need for a device which conveniently displays data, stores data, and relays data regarding the acts of charity and the money donated to a remote database that may be accessible via the internet, creating a global community for charity. Now many different charities can act together while fulfilling their own needs and a global one at the same time The present invention has been developed to help address these needs.

SUMMARY OF THE INVENTION

The present invention relates to a device and system which tally and calculate acts of charity and total amounts of funds to be given to charity.

The invention will be able to make fundraising in congregation and individuals have a more accurate dollar amount of money being raised. It will help and encourage the users to understand the importance of many small acts to create powerful aggregate effect that may change the world.

Physically, the invention is intended to have one or more places to keep a supply of change. After a coin deposit section of a unit fills up, a user may insert a calculated deposited dollar amount in bills which is displayed on an LCD into a bill holder section thereby making change available for the user to use in future charitable acts.

The invention will also help boost morale for individuals giving charity and the morale of the group of worldwide individuals who will look at the worldwide total.

The invention may be used as a teaching tool for schools, camps and individuals to teach people, especially children, how to give charity. It is also used to encourage people to set goals.

The purpose of the invention is to have an interactive community of people giving charity. The amount given is not the only matter calculated and displayed on the display screens of the invention. In one example, out of five screens only one relates to the dollar amount located in the unit but four are given to the act itself.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated are examples. It is understood that the invention is not limited to the precise arrangements and instrumentalities shown, wherein.

DETAILED DESCRIPTION OF THE INVENTION

Figure 1:
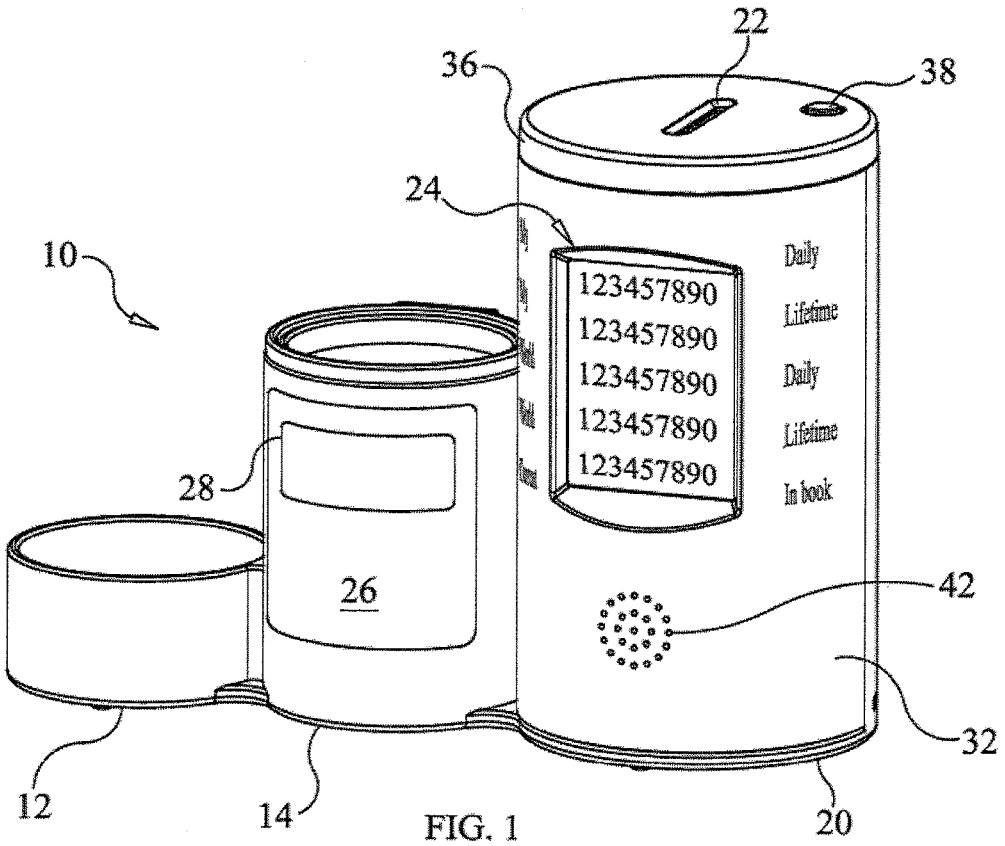
FIG. 1 illustrates a front perspective view of the device of the invention.

The present invention relates to a device and system which tallies and calculates acts of charity and total amounts of funds to be given to charity by an owner or user (hereafter "user").

As shown in FIGS. 1-5, there are at least three sections of the unit 10 of the invention: a lipped tray 12 which may be used as a coin holder, a dollar bill holder 14 which may include a lid 16 having a dollar bill slit 18, and a coin deposit section 20 having a coin deposit slit 22. The coin deposit section 20 is where coins may be deposited by a user. Also, the unit 10 has a plurality of displays 24 such as LED displays. These displays 24 may also be touch screens. The displays may be located on the coin deposit section 20 as shown in the Figures, or they may be located elsewhere on the unit 10.

The lipped tray 12 may hold change to have ready for a user to use to perform charitable acts with the unit 10. One charitable act may be the provision of a predetermined amount of money to a charity. The change in the lipped tray 12 to be designated in the future for charitable acts may also be used for future planning of charitable gifts.

The dollar bill holder 14 may be used to store paper currency that has already been donated. The dollar bill holder 14 may also include a sponsor label space or placard holder 26 for holding a label or placard 28. The label or placard 28 may include identification for a fundraising cause, signage for an organization, or an advertisement.

Figure 6:
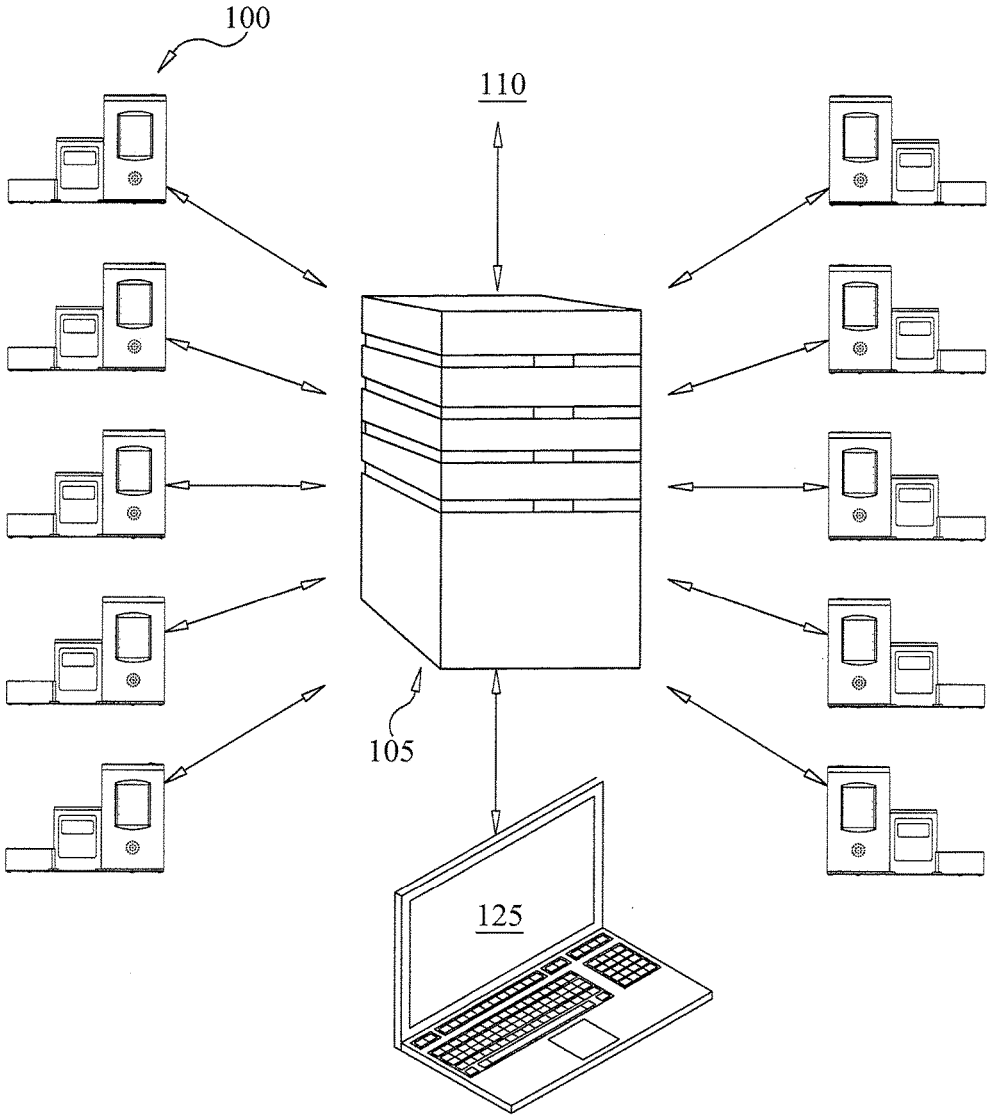
FIG. 6 illustrates a schematic view of the invention.
Figure 7:
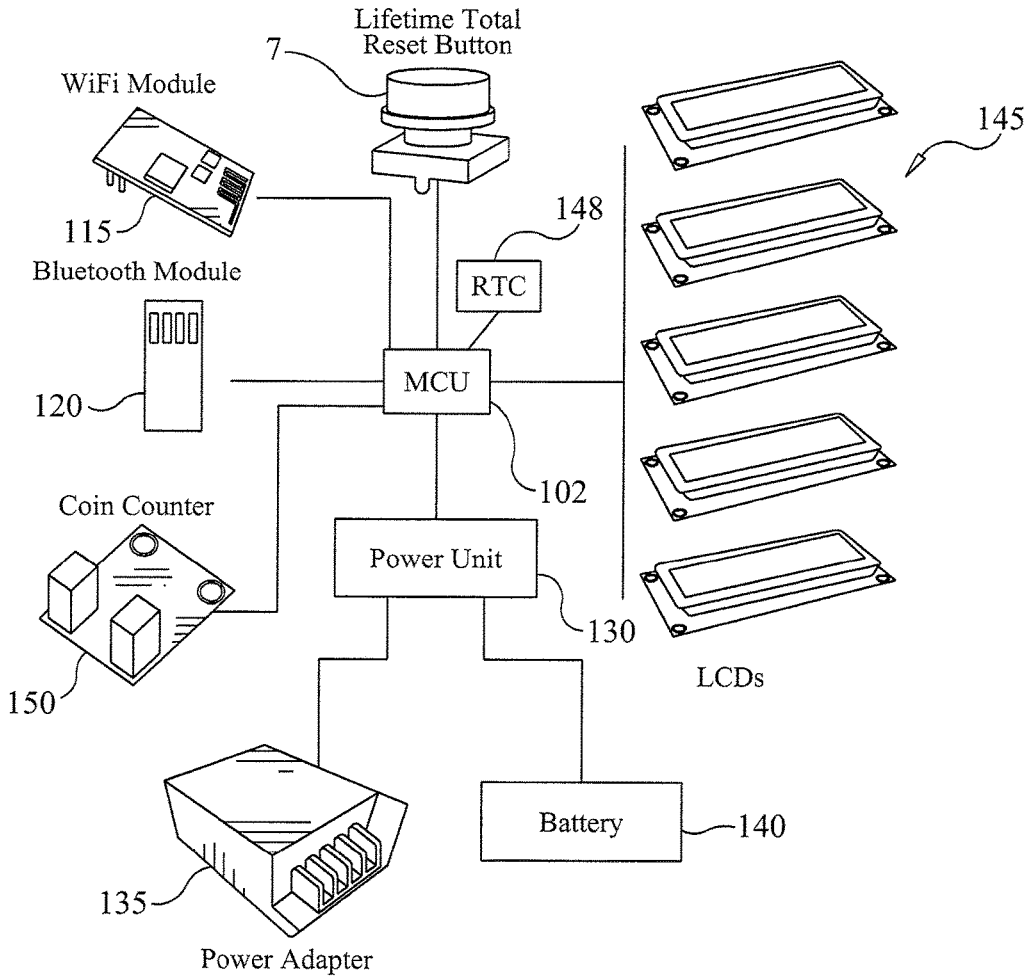
FIG. 7 illustrates a schematic view of the coin collector section of the device of the invention.

The coin deposit section 20 is the mechanical section which also includes electronic components of the unit 10. The electronic components are illustrated in FIGS. 1, 6 and 7. This coin deposit section 20 includes in its interior a coin counter 150 and a hollow compartment 32. The coin counter counts the value of the coins deposited in the coin deposit slot 22, and may also calculate the number of charitable events completed by a user for a prescribed time and/or over a lifetime. The hollow compartment 32 may be enclosed by a door 34. The hollow compartment 32 may be used for holding collected coins deposited through the coin deposit slit 22. Deposited coins may remain in the hollow compartment 32 until they are taken out by a user. These coins may then be replaced into the lipped tray 12 of the unit 10. The coins replaced into the lipped tray 12 may be replaced by dollar bills located in the dollar bill holder.

The coin deposit slit 22 on the coin deposit section 20 may be located on a coin deposit lid 36. The coin deposit lid 36 may be removable. One or more reset buttons 38 may be located on the coin deposit lid 36. Activation of a reset button 38 may reset one or more counters associated with the unit 10, for example, for times, when a user removes coins from the hollow compartment 32 or when a predetermined time for counting acts of charity or money donated has expired.

Figure 2:
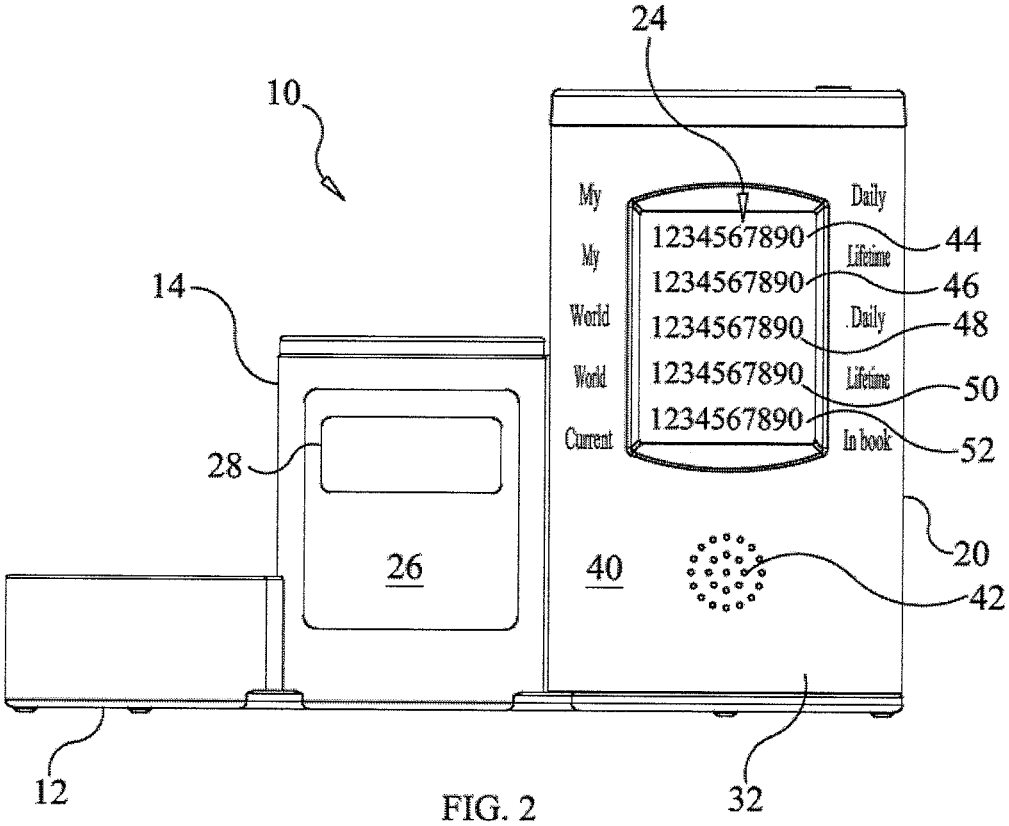
FIG. 2 illustrates a front plan view of the device of the invention.
Figure 3:
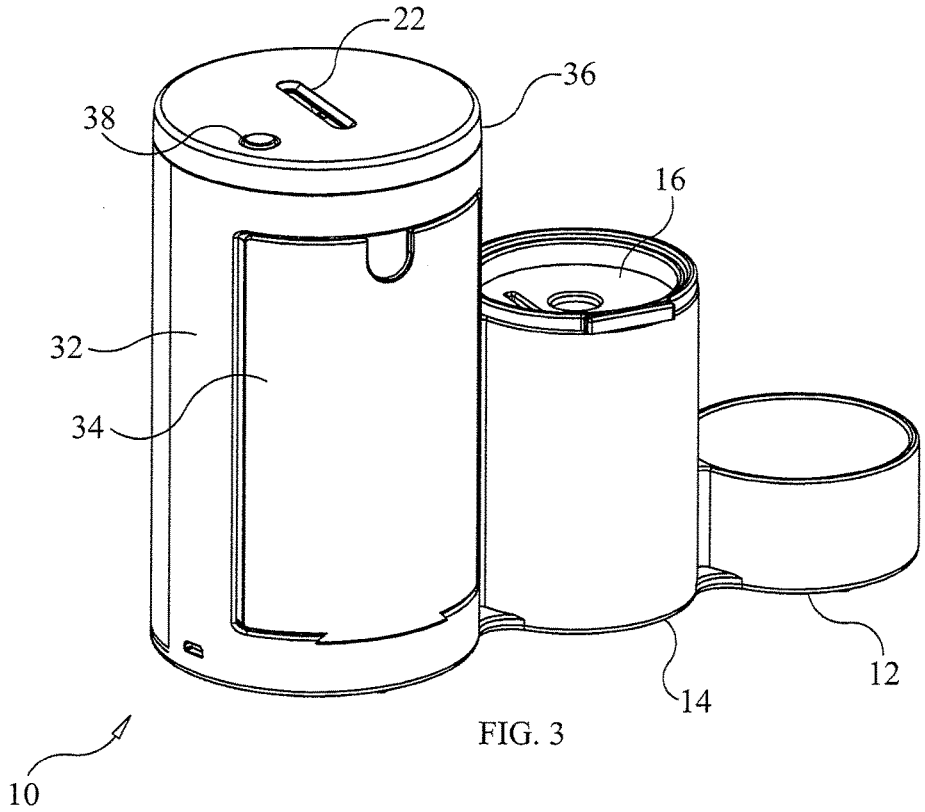
FIG. 3 illustrates a rear perspective view of the device of the invention.
Figure 4:
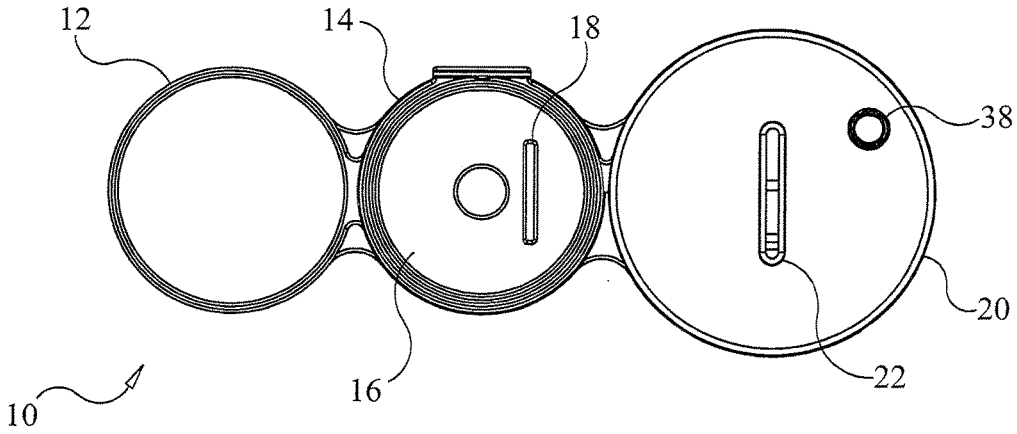
FIG. 4 illustrates a top view of the device of the invention.
Figure 5:
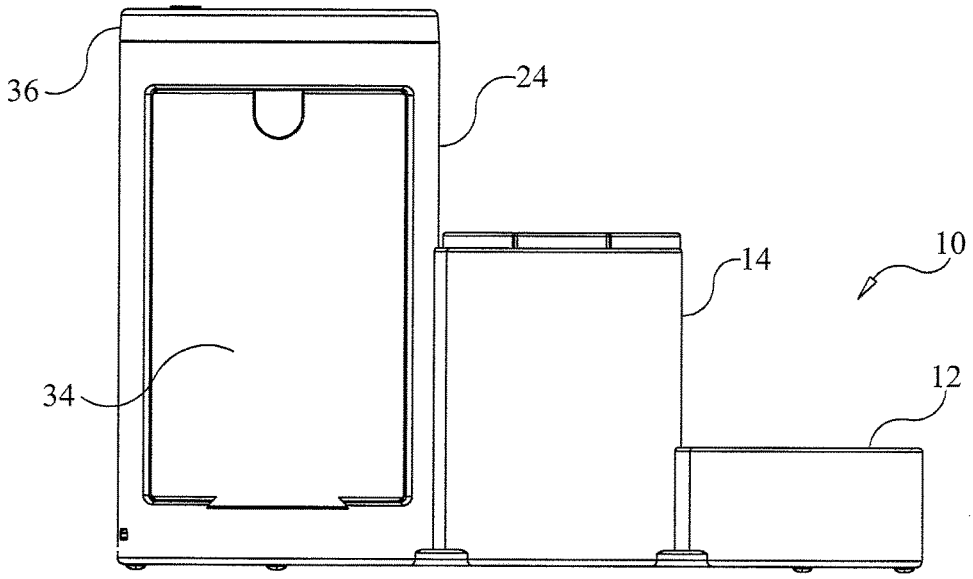
FIG. 5 illustrates a rear plan view of the device of the invention.

In one embodiment, the unit 10 has at least five display screens 24. The display screens 24 may be located on a single LCD or LED screen, or they may comprise several separate distinct displays. The display screens 24 may be located on the coin deposit section 20 as shown in FIGS. 1 and 2 or may be placed elsewhere on the device. In addition, the bottom portion 40 of the coin deposit section 20 may be used for housing some or all of the electronic components within the unit 10.

The unit 10 may also include additional functions. The unit 10 may alternatively or additionally be equipped with a USB or Ethernet connection to obtain remotely stored information for display on the unit on display screens 24. Also, the unit 10 may include one or more speakers 42. Through the speakers 42, the unit 10 will be able to broadcast premade announcements or verbally broadcast remotely or locally stored information. In addition, the speakers may be used to send messages to the unit through a connection to a server.

The information displayed upon display screens 24 may include the donated daily amount of money total 44 and the lifetime amount of money total 46 for the unit.

The information displayed upon display screens 24 may also include the donated daily amount of money total 48 and the lifetime amount of money total 50 for all units linked to a remote database. In addition, the displayed information may include a current amount held 52 in the coin deposit section 20.

Additionally, displayed information may include a daily total of charitable acts and/or a lifetime count of charitable acts. Furthermore, the displayed information may include a world total of charitable acts for the day and a world total of charitable acts over the lifetime of the existence of the database. Additional data from the individual unit and/or the remote database may also be displayed from the display screens 24.

In another configuration, the following displays are provided:

1) The daily total for the box, or coin deposits in the coin deposit section 20;

2) The lifetime total for the box of coin deposits the coin deposit section 20;

3) The daily total for all units around the world;

4) The lifetime total for all units around the world; and

5) Change located in a compartment in the coin deposit section 20.

In one embodiment, as shown in FIGS. 6 and 7, units 100 may be able to communicate with a remote central database 105 located on a local or cloud-based server 110. The communication may be made via a computer 102 such as a microcontroller unit (MCU) located on the unit 100. Communication to the server 110 may be through a Wi-Fi module 115. The unit may be also include a Bluetooth module 120 or similar means of communication for a user to communicate an account number or password for access to the unit 100 or for access to the remote database 105. The computer 102 may be located in or on the unit 100.

As shown in FIG. 7, the server 110 may also be in electronic communication with a computer 125, such as a laptop, tablet or smartphone, for access to a database accessible via a website. The website may be located on the server or hosted internally or with an outside host. A user may use the computer 125 to access to the database 105 and may use a database manager to manage the database of the invention.

The website may display database figures such as cash or acts of tallies for a particular charity, or it may display tallies for several charities which are part of the database. A user who opens an account on the database though the website may have multiple units. Each unit will have an owner and can have a user as well, so the organization can track its units.

A unit may also use Wi-Fi to relay information to a server 110 each time a coin is deposited into the unit 100. A user may be able to connect the unit to Wi-Fi via a graphical user interface such as a touch screen used for the display screen of the unit. The touch screen then may be used to input information needed to connect with Wi-Fi. Connection may also be done through other means known in the art.

As shown in the schematic diagram in FIG. 7, the unit 100 may be powered electrically through a power unit 130. The power unit 130 may use as a power source an AC power adapter 135 or a battery 140 or a similar power source such as a solar cell. In addition, there may be a USB connection on the unit 100 to connect the unit to a power source or for a connection to a computer.

One or more input devices 145 such as touch screen displays or a set of buttons on the unit may be used to input data to the computer 102 for the unit 100. The input device may be used to enter a password to connect to Wi-Fi. The input device may also be used to access data in the database. The input device 145 may LED, LCD or other types of displays which may be located on the unit 100 on the coin deposit section or any separate input device known in the art. A real time clock (RTC) 148 may be in communication with the computer 102 to ensure that the data obtained by the unit is synchronized with the data obtained from other units and data obtained from the remote database 105.

The invention also contemplates that a computer program on the server 110 such as a database manager for the database 105 will interact with each unit 100 of the invention, sending data through its own input devices such as a video screen, LCD and/or speaker. The computer program may be able to add or change announcements and messages on LCDs or touch screens on one or more of the units 100.

The displays on the invention display data which is stored on a server, so that even if the unit loses power, the information persists because it is stored remotely. As mentioned above, the information may be accessed through a predetermined website. A user may set up an account and input an Owner ID and a User ID for each unit, or these identifiers may be provided for each unit. The user's account will tally and store all total count amounts, such as daily totals, lifetime totals, worldwide totals, and dollar amounts for each unit, and allow access and display of associated information as directed by the computer program.

As shown in FIGS. 1-5, the dollar amount total function will be used when a user inserts coins into the coin deposit section 20 of the unit 10. At that time, a coin counter 150 in the unit, shown in FIG. 6, would be activated, and a new total dollar amount for the unit will be uploaded to the database. The unit would display the amount taken from the database. An administrator of the database may then obtain from the database the totals being collected by each of the connected units and aggregated in the database. Relevant statistics regarding the frequency and amount of usage of the individual units or groups of units may then be obtained from the database and database manager. Unit groupings may be by location, account information provided by a user, or by other variables.

Coins in the coin deposit section 20 may eventually be taken out. There will be coins in the coin deposit section 20 and paper currency in 14. The donated money may be physically taken to a charity. Coins may be bought from the coin deposit section 20 to the lipped tray 12 to reuse after paper currency in the amount of the cash value displayed as located in the coin deposit section 20 is exchanged. Thus, the unit 10 and the database 105 are able to track individual acts of charity distinctly from physical donations. A user may also insert a predetermined dollar amount, such as a predetermined daily dollar total amount, into dollar bill holder 14, thereby making bills and change available for the user. The user may then at a predetermined time reset the device 10 by pushing the reset button 38 and resetting the appropriate counters in the device. This reset button on the unit 10 will only reset the counters for calculated amounts for a unit 10 and will not affect any of the amounts in the database on the server. The database tally for the dollar designated for a charity amount in the unit 10 can reset when the charity organization receives the month.

For example, the display for a daily dollar total amount may read $2.00 in change located in the coin deposit section 20. A user would take two dollars out of pocket and place them into the bill holder 14. Then a user would open the door 34 to the back section of the coin deposit section 20 (which is removable and stores the coins), remove the coins and then put the coins into the lipped tray 12. Thus, the lipped tray holds $2.00 worth of change in exchange for the $2.00 from the user's pocket. Placement of the coins in the tray will create change for the user to continue to use them so that the coin counter 150 may be reactivated. At this point, the transaction is completed to make change available to user, The reset button 38 may be pushed and the display 24 displaying the daily dollar amount would return to 0.00.

The coin deposit section 20 is openable and may be a removable vessel. The bill holder 14 also may be removable or otherwise openable. Different compartments for the coin deposit section 20 may be made to accommodate different countries' currencies.

In another example of use of the invention, a user may insert a coin into the coin deposit section 20. The insertion will count as a single act of charity. It will also count as a single tally towards the user's daily total for acts of charity, the user's lifetime total for acts of charity and the worldwide total for acts of charity. In addition, the invention provides tallies for the dollar amount given as part of the charitable acts. With this information, a user may set goals for increased charitable work or for maintenance of current levels of charitable work. For example, a user may look at a daily total at the end of the day and then set a goal for the next day for 5 more acts of charity. Another example would be for a user to look at the lifetime total of charitable acts or money donated and, noting that there have been 1000 lifetime acts of kindness, set a goal of lifetime acts for a total of 2000 by next year. Regardless, the user is encouraged by the tracking of the charitable acts completed.

The following additional embodiments of the invention are also contemplated:

The database and database manager of the invention may combine different causes and have a common denominator so that all the charity is transformed into a unifying act.

The invention may also be used for any cause or religion. For example, a sick family member or friend of a user may use the invention for the user's own cause. Furthermore, the invention may be used for several charities simultaneously.

In the unit 10 as illustrated, the lipped tray 12, the dollar bill holder 14 and the coin deposit section 20 are all cylindrical and have approximately the same diameter. Other shapes, such as ovals and squares are also contemplated. Also, the three sections are shown in horizontal orientation, but they may be in vertical orientation or the three sections may be angled from each other.

Furthermore, the bottom portion of the lipped tray 12 is connected to a first side of the bottom portion of the dollar bill holder 14, and the coin deposit section 20 is connected to a second side of the bottom portion of the dollar bill holder. A sponsor label space 26 is located on a front portion of the dollar bill holder, and a display 24 is located on a front portion of the coin deposit section 20.

Also, the invention may include a function so that charity will be able to be sent funds directly from the website based on deposits into box. Prior to this invention, a charity would need to send a person to collect money from a charity box in a specific location. The website associated with the invention allows a user to choose when and where the money will be sent based on his deposits with the invention. For example, if a user deposits $10 into the box in a month, the user may request that the website associated with the invention automatically send that money from the user's credit card, bank account or PayPal account to the charity. Thus, the need to pick up the money from the charity box is removed.

What is claimed is:

1. A charity box device, comprising:

a. a lipped tray;

b. a dollar bill holder including a lid and a dollar bill slit; and c. a coin deposit section including:

(1) a coin deposit slit;

(2) a coin compartment; and (3) one or more displays; and d. a microcontroller unit, wherein the lipped tray is connected to the dollar bill holder on a first side of the dollar bill holder, and wherein the coin deposit section is connected to the dollar bill holder on a second side opposite the first side of the dollar bill holder.

2. The charity box device of claim 1, wherein the displays are one or more touch screens.

3. The charity box device of claim 1, wherein the dollar bill holder further comprises at least one of a sponsor label space and a placard holder.

4. The charity box device of claim 1, wherein the lipped tray, the dollar bill holder and the coin deposit section each are cylindrical.

5. The charity box device of claim 1, wherein the lipped tray, the dollar bill holder and the coin deposit section each are in horizontally aligned.

6. The charity box device of claim 1, further comprising a speaker located on the coin deposit section in electronic communication with the microcontroller unit.

7. The charity box device of claim 1, further comprising a reset button in electronic communication with the microcontroller unit located on the coin deposit section.

8. The charity box device of claim 1, further comprising at least one of a Bluetooth connection, a USB connection and a Wi-Fi connection in electronic communication with the microcontroller unit.

9. The charity box device of claim 8, wherein the display shows a. the daily total of funds for the charity box device;

b. the lifetime total of funds donated for the charity box device;

c. the daily total of funds for all the charity box devices connected to the database; and d. the lifetime total of funds for all boxes connected to the database.

10. The charity box device of claim 8, wherein the display shows:

a. the daily total of charitable acts for the charity box device;

b. the lifetime total of charitable acts for the charity box device;

c. the daily total of charitable acts for all the charity box devices connected to the database; and d. the lifetime total of charitable acts for all the charity box devices connected to the database.

11. The charity box device of claim 1, wherein the microcontroller unit is in electronic communication with a remote central database, wherein the database is in electronic communication with additional charity box devices.

12. The charity box device of claim 11, wherein the display shows:

a. the daily total of charitable acts for the charity box device;

b. the lifetime total of charitable acts for the charity box device;

c. the daily total of charitable acts for all the charity box devices connected to the database; and d. the lifetime total of charitable acts for all the charity box devices connected to the database.

* * * * *